United States Patent [19]

Marynissen

[11] 4,039,088

[45] Aug. 2, 1977

[54] TRANSFER APPARATUS

[75] Inventor: William E. Marynissen, Old Greenwich, Conn.

[73] Assignee: Bic Pen Corporation, Milford, Conn.

[21] Appl. No.: 637,048

[22] Filed: Dec. 2, 1975

[51] Int. Cl.[2] ..... B65G 57/04

[52] U.S. Cl. ..... 214/1 BT; 214/8.5 D; 214/147 T

[58] Field of Search ..... 214/1 BB, 1 BT, 8.5 C, 214/658, 147 T, 8.5 D, 650 SG

[56] References Cited

U.S. PATENT DOCUMENTS

| | | | |
|---|---|---|---|
| 2,531,870 | 11/1950 | Bettini | 214/1 BB |
| 3,033,387 | 5/1962 | Greenberg | 214/1 BB |
| 3,774,778 | 11/1973 | Flaig | 214/1 BT |
| 3,921,820 | 11/1975 | Crockett | 214/1 BB |

*Primary Examiner*—Albert J. Makay
*Assistant Examiner*—George F. Abraham
*Attorney, Agent, or Firm*—Pennie & Edmonds

[57] ABSTRACT

A transporter apparatus for movement of plastic blister members to a conveyor for processing, i.e., for receiving an article in a pocket of the same and a backing card for closing the pocket opening and enclosing the article therein, includes a frame for supporting an assembly having a carriage movable in the vertical direction and a plurality of transfer rods supported by the carriage. The transfer rods are disposed in a horizontal attitude and divergent outwardly from a pick-up zone of blister members to the conveyor. Transfer devices including structure for "gripping" the blister members are supported by the transfer rods. The transfer devices are connected to a pair of transfer arms and driven along the transfer rods as the transfer arms are themselves driven. A drive mechanism including mechanical actuators impart movement to both the carriage and the transfer devices upon control signals to the drive mechanism.

13 Claims, 8 Drawing Figures

1 FILM FEED
2 LOWER FORMER
3 UPPER FORMER
4 VACUUM (BLISTER FORM)
5 BLISTER TRANS. DOWN
6 KNIFE
7 VACUUM (BLISTER TRANS)
8 BLISTER TRANS. UP
9 BLISTER TRANS. FORWARD
10 BLISTER TRANS. DOWN
11 AIR
12 BLISTER TRANS. UP
13 BLISTER TRANS. RETURN
14 CONVEYOR INDEX
15 CARD PICKER
16 CARD SEAL
17 CARD EJECT
18 VACUUM (CARD SEAL)
19 LOAD ARTICLE
0
28.5 35.7 42.8 50
32.1 46.4
78.6 85.7 92.8 100%
82.1 89.3 96.4
0 TIME (seconds)
1 22.2
2 44.4
3 33.3
4 100%

TRANSFER APPARATUS

BACKGROUND OF THE INVENTION

It is known in the prior art that articles of manufacture may be supplied for sale in the retail trade within the pocket of a blister member mounted on and sealed to a backing card thereby to encase the article in its individual package. The material of the blister member preferably is transparent so that the article within the pocket may be viewed before purchase.

In the overall packaging operation, the individual blister members normally are formed from plastic sheet material, such as polyvinylchloride, and processed under heat and pressure within a mold. The individual blister members of a row including a number of blister members in side-by-side orientation thereafter are moved from the forming equipment to a conveyor providing an equal number of supports such as cup-like openings for receipt of the blister members with the pocket upwardly exposed. The conveyor is advanced in stepped fashion to receive the blister members seriatim within the supports and move these blister members to and through various stations at which an article is loaded in the pocket and encased by sealing the backing card to the blister member. The backing card supports the blister member and vice versa along a flanged surface extending outwardly at the opening to the article receiving pocket.

In one prior art apparatus, the blister members are moved from the forming equipment to the conveyor by passage along a chute. Such movement is by gravity fall. This operation is not without problems. A major problem develops through build-up of static electricity on the blister members resulting in possible "hang-up" of the blister member in the chute to the conveyor. Thus, less than a complete complement of blister members are received by the conveyor. Even the use of electrostatic dissipaters has not solved this problem, which if severe, often times requires shut-down of equipment. In an attempt to better assure movement of the blister members by the force of gravity without "hang-up" along the chute, the thickness of the sheet material stock has been maintained at about 5 mils; whereas, it is clear that the packaging industry could realize a material cost savings by the reduction of thickness of the sheet material stock to a permissible and operable thickness of 4 mils or even less. This, however, has not been possible for a reduction in the thickness of the sheet material would have the result of aggravating the problem of "hang-up". Even though the cost savings, considered a product output which may be millions of units, may be substantial, it is likely that the cost savings would be negated by losses sustained in downtime of equipment, for example.

BRIEF DESCRIPTION OF THE INVENTION

The present invention is directed to a transporter apparatus whereby a blister member or members may be "gripped"after passage from the forming equipment and by transporting equipment activated by mechanical drive means moved to an deposited in a support on a conveyor. The action of the transporter apparatus and the mechanical drive means is a positive action of movement of blister members thereby to overcome the problem of "hang-up" of blister members in movement along a chute of the described prior art apparatus. The transporter apparatus of the present invention permits use of sheet material having reduced thickness with attendant cost savings.

DESCRIPTION OF THE PREFERRED EMBODIMENT

The transporter apparatus and the mechanical drive means form an integral part of a packaging machine that in the environment to be discussed provides as a final product a packaged article of manufacture such as, for example, a writing instrument or a cigarette lighter, in a form suitable both for display and sale. The package includes a housing formed by a blister member having a peripheral outwardly extending flange at an opening leading to a pocket of a size and shape to accommodate the article therein. The package also includes a backing card which is received over and pocket opening and supported permanently as by heat sealing or by any equivalent technique to the blister member. The backing card may be provided with desired indicia and/or illustrative material.

In the embodiment of the present invention, the transporter apparatus is adapted to convey a blister member or, preferably, a plurality of blister members arranged in a side-by-side relation from one location, a pick-up zone at the discharge of a first conveyor connecting with blister member forming equipment, to a second location at which each blister member is deposited in a support on a second conveyor. The second conveyor moves the blister member or, preferably, several blister members in side-by-side disposition to and through a plurality of stations at which operations such as that of depositing the particular article in the pocket of each blister member, placing a backing card on each blister member to close the pocket, sealing the backing card to each blister member, and other operations may be carried out.

Figure 1:
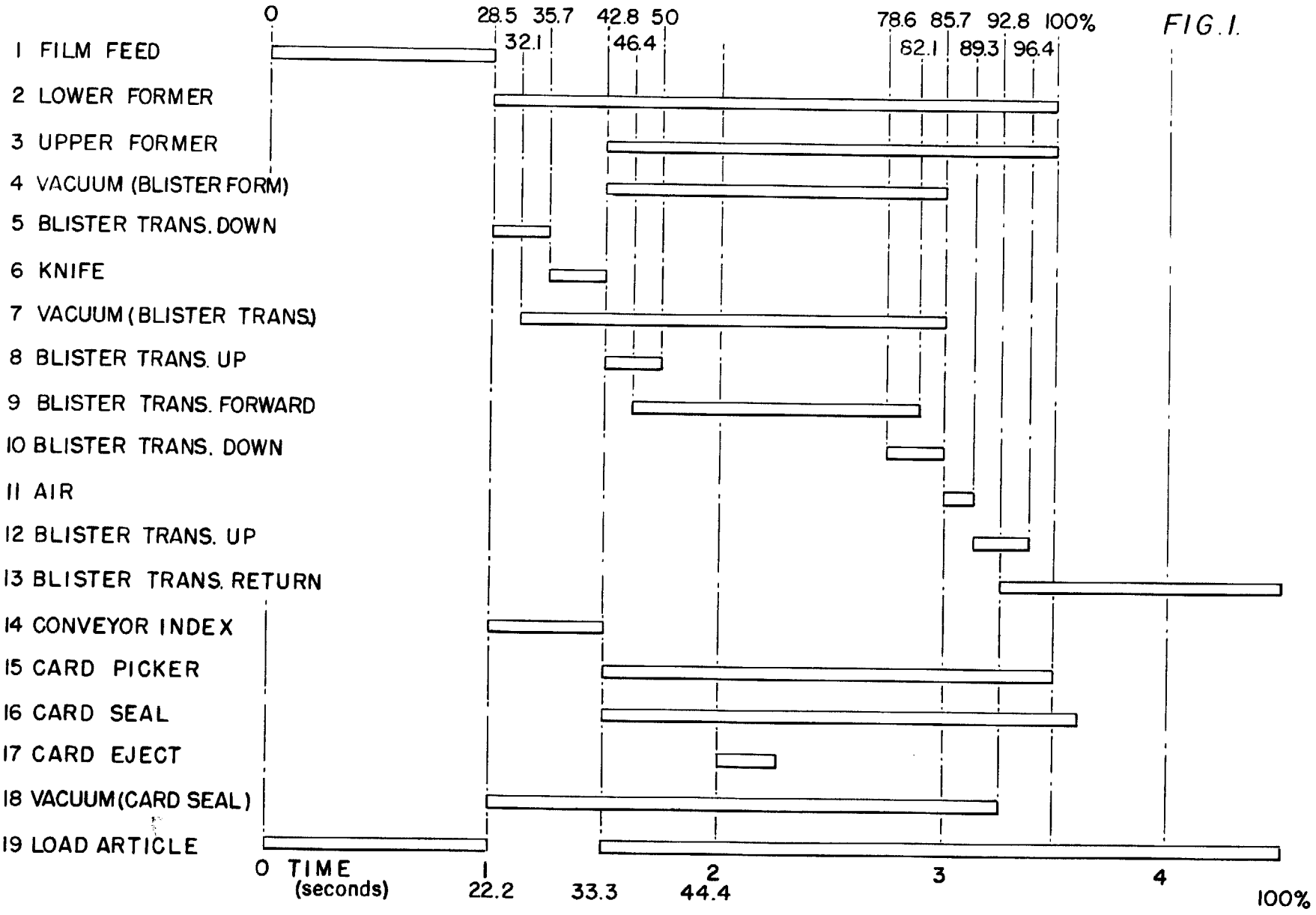
FIG. 1 is a diagrammatic time study presentation of certain sequences of operation of structure forming a packaging machine and including the sequences of the transporter apparatus of the present invention.

Through reference now to FIG. 1, an operative sequence of a cycle of operation including the operative sequences of forming blister members and transporting the blister members to the second conveyor for purposes as above will become clear. The complete sequence of events in each cycle of operation may be completed within a time frame of about four and one-half seconds time. The percentages at the bottom of the figure relate the time of commencement and completion of various steps over the complete sequence; whereas, the percentages at the top of the figure relate to steps in the process of forming blister members which are completed during a shorter time interval.

As indicated, it is preferable that a plurality of blister members are formed simultaneously and that a complement thereof are presented at the pick-up zone in side-by-side relation for transport simultaneously. As apparent from FIG. 1, blister members are formed as operations on previously formed blister members are carried out. Generally, in the formation of blister members a length of sheet material is indexed forwardly from an endless roll of plastic sheet material during an interval of about one second from time "zero" ($T_O$) seconds at the commencement of a cycle. The sheet material is indexed between a pair of former members. After a delay of about one-half second, during which time the indexed length of sheet material is cut from the endless roll (see step 6), one of the former members is moved relative to the other former member or both former members are moved together in the closing direction whereby the sheet material is contacted tightly by both former members. The former members are maintained closed about the sheet material for about two seconds, during which time the sheet material is subjected both to heat and pressure. For this purpose, one former member may be provided with a cavity of the size and shape of the pocket desired. The other former member may include a flat face and either former member may be connected to a source of pressure such that the sheet material conforms to the outline of the cavity. Either one or both of the former members may be internally heated for purposes of molding the sheet material to form a blister member. This blister member may be formed of polyvinylchloride.

These operations of the packaging machine form no part of the present invention and are discussed for purposes of providing an overall view of the total operation. The process of indexing the sheet material and forming the blister member is completed in about three and one-half seconds (see steps 1–4).

Referring now to the operation for locating blister members from the pick-up zone to the second conveyor, assume as a starting point that the carriage of the transporter apparatus is at rest in a raised limit position (see step 5). After a period of dwell of about one second, the carriage of the transporter apparatus is actuated from the condition of rest toward the blister members within the pick-up zone. Movement is vertically downward and uniform over a period of time of about one-quarter of a second.

Each blister member at the pick-up zone is "gripped" by at least one pick-up tip carried by the transfer device. Preferably, the carriage of the transporter apparatus will support a plurality of transfer devices and each transfer device will act upon a single one of the blister members at the pick-up zone. In the present embodiment, the carriage of the transporter apparatus supports a plurality of six transfer devices, but as should be apparent, the carriage of the transporter apparatus likewise could support either a greater or lesser number as requirements demand.

The "gripping" of the blister member is through the application of negative pressure at the pick-up tip of the transfer device. The application of negative pressure, commenced during descent of the carriage of the transporter apparatus, is continuous throughout a period of approximately 2 seconds (see step 7) at which time it is discontinued. A blast of air at the pick-up tip will assist in dislodging the blister member which no longer is subjected to negative pressure from the pick-up tip so that it may fall a short distance to the second conveyor.

After a short dwell period at the pick-up zone during which time the blister member is "gripped", the carriage of the transporter apparatus begins its ascent again to the raised limit position. Ascent of the carriage of the transporter apparatus is carried out over a like period of time. The mechanical drive means for imparting movement to the carriage of the transporter apparatus, as well as to the transfer devices carried thereby, will be particularly described below. Suffice it to say at this time that the mechanical drive means, during vertical upward movement, activates a switch which signals a control that the carriage of the transporter apparatus has cleared a lower limit position so that the mechanical drive means may function to move the transfer devices and the blister members carried thereby from the pick-up to the second conveyor. Movement of each transfer device first is in the vertical direction, then along a path which is the resultant of vectors in the vertical, horizontal (forward) and lateral (outward) directions until the carriage of the transporter apparatus reaches the raised limit position, then along a path which is the resultant of vectors in the latter two directions, and finally along a path during descent of the carriage of the transporter apparatus to the lower limit position which is similar to although the reverse of the path of ascent. When the carriage of the transporter apparatus has descended to about the lower limit position, the transfer device will have moved laterally to their maximum spacing.

As illustrated in FIG. 1, the carriage of the transporter apparatus arrives at the lower limit position at about time $T_3$ for deposit of the blister members in the supports in the second conveyor. The application of negative pressure is discontinued at this time so that the blister members may fall by gravity to their supports. The short blast of air heretofore mentioned will assure dislodgement of the blister members (see steps 5 and 7–11).

Through the movements described, i.e., by movement of the carriage of the transporter apparatus in the vertical direction and of the transfer devices along paths which are the resultant of vectors both in two-dimensions and three-dimensions, a plurality of blister members disposed in closely spaced relation at the pick-up zone may be deposited in supports in the second conveyor which are more widely but equidistantly spaced.

When the blister members have been deposited, the carriage of the transporter apparatus returns to the position first described. The transfer devices likewise return to the position first described, all movements being the reverse of those discussed and over a similar length of time.

The various stated periods such as the period of initial dwell, the periods during which there is movement of the transporter apparatus and the tranfer device and so forth which are set out in FIG. 1 may be extended or shortened as desired or as system demands require. Therefore, the stated periods of time are to be considered not as limiting in any sense but, rather, as being exemplary of a typical cycle of operation.

During the above operations, the second conveyor is stepped through a single indexing movement to locate a plurality of supports, such as a cut-out in a conveyor belt, for receipt of a like plurality of blister members. In the present embodiment, the stepped advance of the second conveyor commences at about time $T_1$ seconds. Stepping of the second conveyor requires about one-half seconds time. An article may be loaded in each pocket of the several blister members theretofore deposited. After an index of the second conveyor for receipt of a further complement of blister members in a following series of cut-outs, the first deposited blister members may be covered by backing cards. Thereafter, the second conveyor is stepped again so that at a sealing station the backing card may be sealed to the blister member to encase the article (see steps 14–19). Thereafter, the second conveyor and blister members are stepped to a packing station.

Now having acquired an overall view of the nature and general operation of the packaging machine, attention is directed to each of FIGS. 2–6 which illustrate the mechanical drive means and the transporter apparatus now to be described.

Referring now to FIGS. 2–6, the transporter apparatus 10 is supported by a frame including a pair of spaced elongated side members 12, 14 formed by angle brackets having an upper surface 12*a*, 14*a* and a depending inner side surface 12*b*, 14*b*, ("inner side" being toward the longitudinal axis of the transporter apparatus), a top plate 16 and a plurality of stanchions 18, 20, 22 and 24. The several stanchions extend between the top plate and the side members to maintain a spacing therebetween. Securement of each stanchion may be by any convenient means such as by bolts 26 received through a base plate 28 and an upper plate 30 to engage with the upper surface of the side members and the lower surface of the top plate, respectively. As illustrated, the stanchions are arranged in a rectangular array (see FIG. 5) and are of a length such that the space between the top plate and the side members accommodates the structure of the carriage of the transporter apparatus. A plurality of members 12*c*, 14*c* are connected between the respective upper and depending inner side surfaces for strength considerations (see FIG. 6).

The side members 12, 14 of the frame are disposed a convenient distance above the floor (not shown) by means of a further plurality of leg stanchions (also not shown).

A plurality of shaft support members 32, 34, 36 and 38 are carried by weldments 32*a*, 34*a*, etc. supported on the underside of the top plate 16. The shaft support members are disposed inwardly of the stanchions 18, 20, etc. toward the longitudinal axis and at further spacing than are the stanchions. The disposition of the support members, likewise, is in a rectangular array. A guide post 40 is supported by each of the shaft support members in a manner to extend away from the top plate 16 in a parallel family. Each guide post preferably, is formed of metal having a polished outer cylindrical surface. A housing 42 is received on each guide post and slidable therealong under controlled movement between the rasised and lower limit positions. A bushing 44 is received internally of each housing 42 for contact with the surface of the guide post thereby to reduce sliding friction. As may be seen in FIG. 6, each guide post is secured to the respective shaft support member by one or more set screws 41 or equivalent structure received through the shaft support member for cooperation, for example, in an annular cut-out (not shown) formed in the guide post. Each housing, also, may include a grease fitting for lubrication of the bushing.

A cross bar 48 is connected between a rearward pair of housings. A similar cross bar 50 is connected between a forward pair of housings. The designation "rearward" and "forward" is with reference to housings near the pick-up zone and the housings near the location at which the blister members 46 are deposited, respectively. The connection is provided by a cross bar holder 52 including a cylindrical bore at one end and an arm at the other end. The cross bar holder is mounted to the housing by a shoulder screw 54 received through the arm. And the cross bars are received in the cylindrical bores of spaced cross bar holders to span across the longitudinal axis of the transporter apparatus. A spring 56 retained between the head of the shoulder screw and the arm permits a somewhat yielding or floating mount of the cross bars. Thus, each cross bar is able to undergo slight movement to obviate possible binding of structure during operation.

Figure 5:
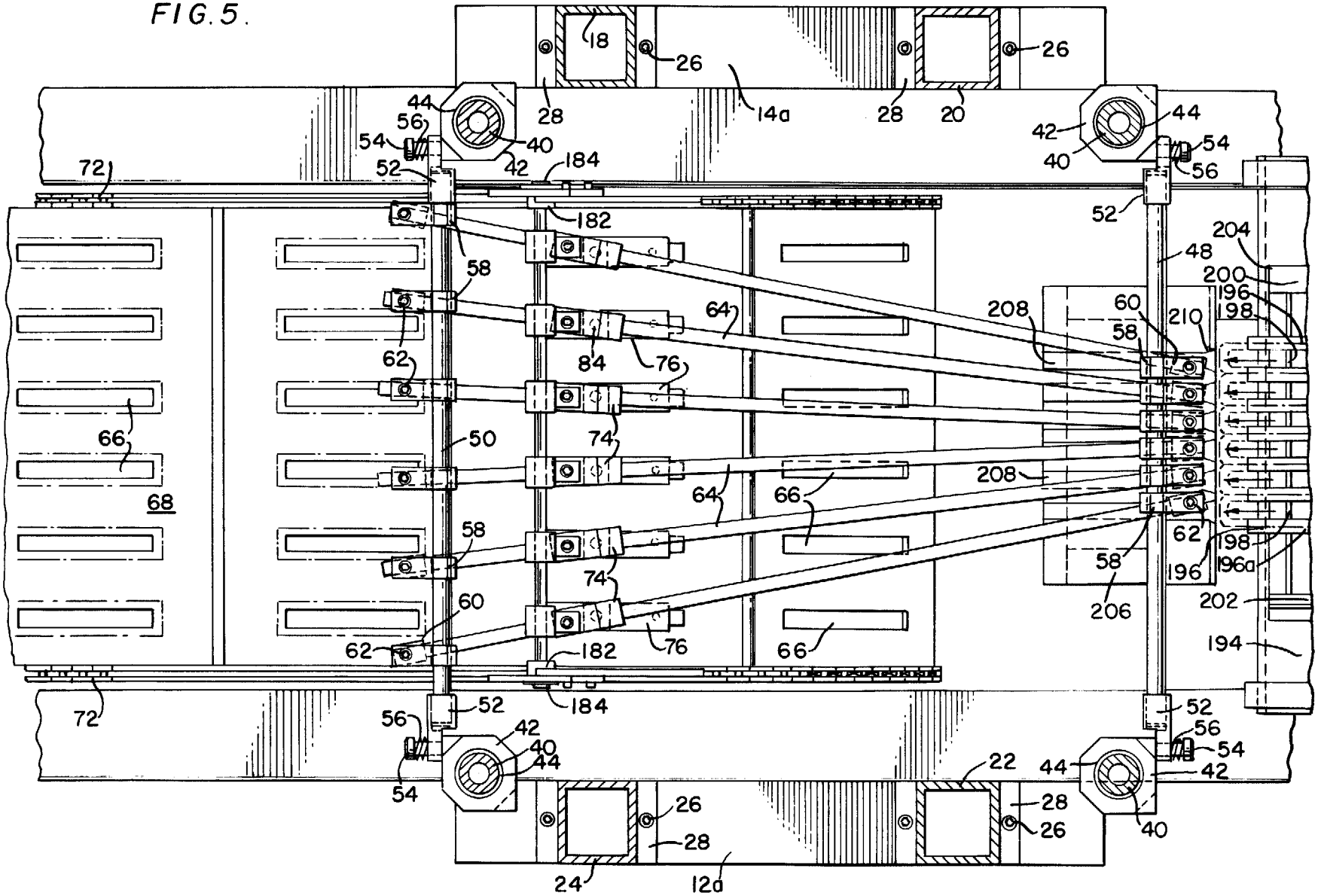
FIG. 5 is a horizontal section as seen along the line 5—5 in FIG. 2, certain structure being removed for the sake of enhancement of clarity of the illustrated structure.

A plurality of collars 58 are disposed on each cross bar 48, 50. As best illustrated in FIG. 5, the collars on the cross bar 48 are disposed at relatively closely spaced intervals while the collars on the cross bar 50 are disposed at intervals which are more widely spaced. Each of the collars includes a portion extending rearwardly of the bore through which the cross bar extends. A transfer rod holder 60 is disposed below the collar and secured thereto by a bolt 62 which is received through a bore in the rearward portion of the collar and threaded into the transfer rod holder. Each of the transfer rod holders includes a through bore and a transfer rod 64 is supported between a forward and rearward pair of transfer rod holders 60. The orientation of each collar on the respective cross bars and, accordingly, the angle of divergence of each transfer rod, as discussed, may be fixed in any manner. The several collars may be provided with a bushing and a seal within the bore for contact with the cross bars for purposes as are well known. As will be apparent, the transfer rods, also, are adjustably fixed against longitudinal movement.

In the embodiment illustrated, the transporter apparatus supports a plurality of six transfer rods thereby to accommodate in movement from the pick-up zone a plurality of six blister members 46. Upon a transporting operation the blister members are deposited in support openings 66 in conveyor 68, hereinabove referred to as the second conveyor.

Conveyor 68 may be of any form such as the endless web of material entrained about a pair of spaced drums 70 (only one is shown in the figures). The drums may include a pair of toothed end flanges which cooperates with a pair of endless chains 72 and one of the drums is connected to a drive (not shown) for indexing the conveyor 68 and locating a support opening 66 for receipt of blister members 46.

Figure 7:
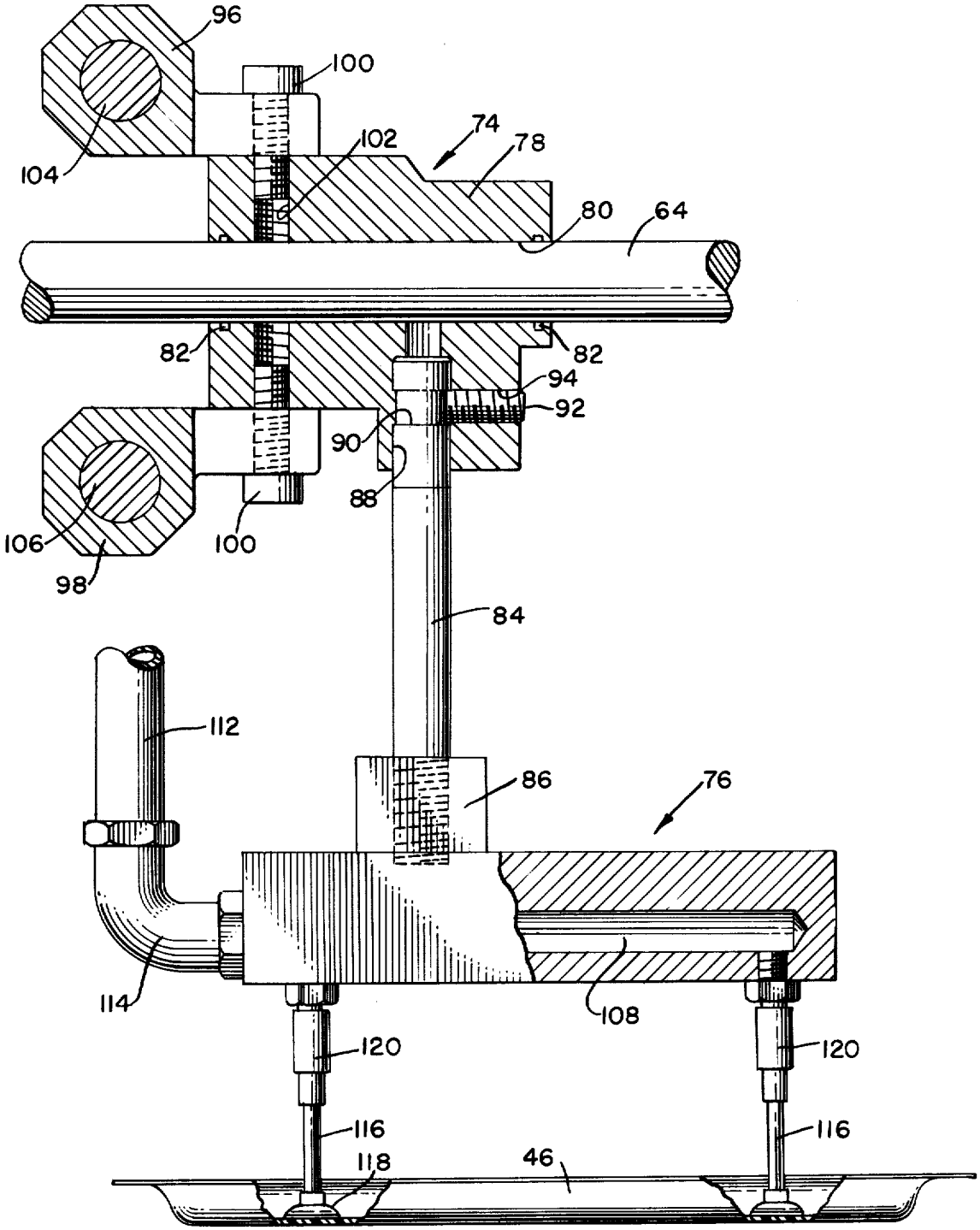
FIG. 7 is a vertical section as seen along the lines 7—7 in FIG. 6; and, FIG. 8 is a top plan view of a drive mechanism for the transporter apparatus.

The transfer device for supporting a blister member 46 for movement may be seen to best advantage in FIG. 7. The transfer device includes a transfer block 74 and a pick-up head 76. The transfer block includes a body 78 having a bore 80. The body is mounted for sliding movement along the transfer rod 64. A pair of ring-shaped bearing members 82 are supported within a pair of annular cut-outs in the body for contact with the transfer rod during movement thereby to reduce friction and assist in a substantially constant movement of the body. The pick-up head 76 is carried by the body 78 at one end of a connecting rod 84. The connecting rod is threaded in a tapped bore in a hub 86 extending upwardly of the pick-up head and received in a bore 88 formed in the body 78. A set screw 92 threaded in a tapped bore 94 of the body 78 cooperates with an annular cut-out 90 formed in the rod to secure the rod. The set screw when tightened securely, also, angularly locates the pick-up head 76 relative to the transfer block 74.

As previously set out, each blister member 46 not only is advanced forwardly but during advance is moved laterally outwardly as well. We have seen that the lateral movement is accomplished by the angle of divergence of the transfer rods 64 toward the side members 12, 14 in the direction of the second conveyor. So that the blister members 46 may be deposited on the second conveyor 68 in the support openings which are located along axes parallel to longitudinal axis of the transporter apparatus, all of the pick-up heads 76 are oriented at an angle to the transfer blocks 74 such that blister members at the pick-up zone may be "gripped", then advanced and finally deposited without having undergone any change in longitudinal attitude.

During this movement, the transfer device is maintained, in a single orientation on the transfer rod. For this purpose, the transfer device carries a pair of bearing holders including an upper holder 86 and a lower holder 98. Securement of the bearing holders may be by means of a screw 100 received through an opening in each bearing holder and threaded into tapped bores 102 in the body 78 of transfer block 74. By tightening down on the screw, the angular orientation of the bearing holders and the transfer block 74 may be maintained.

A pair of transfer block rod 104, 106 supported at their ends by the mechanical drive means to be discussed are received through a bore in each bearing holder 96, 98. The transfer block rods are disposed one above the other and their axes in all positions of forward movement of the transfer device lie not only in a vertical plane but also perpendicular to a plane including the axes of each transfer rod 64. The bearing holders may support a ball bushing or similar structure (not shown) thereby to maintain sliding friction of the bearing holders on the transfer block rods at a minimum.

Each pick-up head 76 includes an elongated bore 108 which is connected to a manifold 110. To this end, a tube 112 is connected at each end to a pressure connector 114 received in both the pick-up head and the manifold. In the present embodiment, there are two manifolds, each serving as a pressure source for the complement of pick-up heads on opposite sides of the longitudinal axis of the transporter apparatus.

A pair of probes 116 with pick-up tips 118 in the form of a suction cup are carried by each pick-up head 76. The probes are connected by pressure connectors 120 to the bore 108. Preferably, the probes are carried at a spaced relation thereby to cooperate with the blister member 46 at spaced locations along its length.

The manner of imparting movement to the carriage of the transporter apparatus now will be discussed. Movement, as discussed, consists of movements in the vertical direction between limits at a raised and lowered position and is undergone in unison by the housings 42, the cross bars 48, 50, and the transfer rods 64 which generally comprise the carriage of the transporter apparatus. For this purpose, the transporter apparatus provides a plurality of rods 122 and a plurality of elevating levers 126. The elevating levers are supported by structure carried by the top plate 16 and laterally outward of the top plate (see FIG. 8) thereby not to be impeded in pivotal movement. Each rod is connected at one end to an individual one of the housings 42 and at the other end to an arm 124 of one of the elevating levers. A rod end connector 123 is threaded on one or both ends of the individual rods through a number of turns as is required for securement and adjustment of length of the rod and locked in the adjusted position by a nut 125. Each rod end connector is provided with a flattened end including an opening. A socket head screw and lock washer 127 may be used for securement of the rod end connectors with each housing 42 and each arm 124 of the respective elevating levers 126.

A shaft or connecting rod 128 supports the forward elevating levers for pivotal movement. A pair of spaced mounting brackets 134 are supported by the top plate 16 above and in axial alignment with the weldments **32*a*, 38*a* and, in turn, provide journel support for the connecting rod 128. Further support, as needed, may be provided by additional mounting brackets disposed at spaced locations between the mounting brackets 134. The forward elevating levers are keyed or otherwise secured to the connecting rod 128** for movement in unison.

Figure 8:
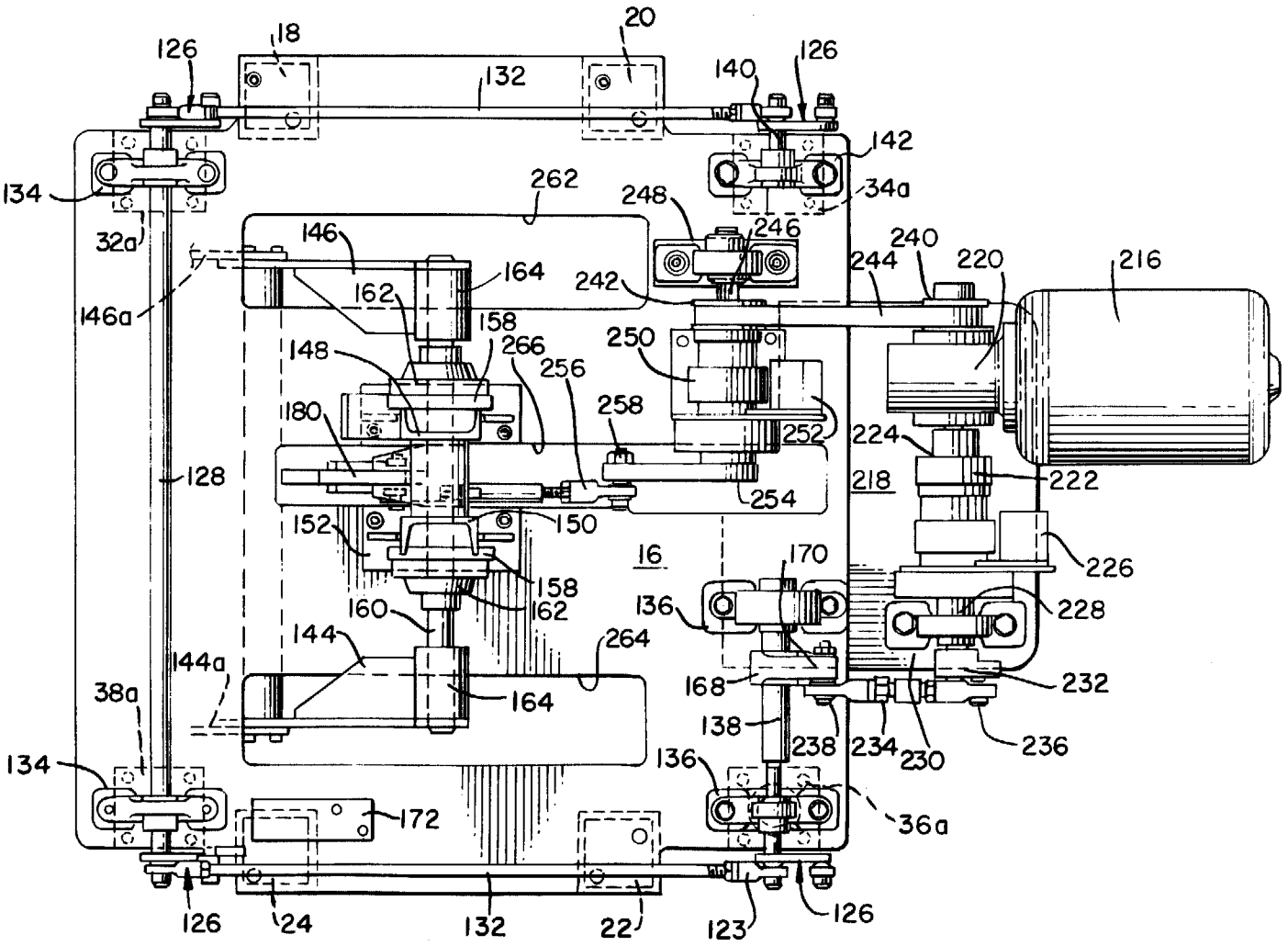

The rearward elevating levers 126 are mounted substantially in a similar manner. Referring to FIG. 8, a pair of mounting bracket 136, one of which is supported by the top plate 16 above the weldment **36*a* and a second of which is spaced therefrom, support a connecting rod 138. The connecting rod extends through a pair of journels carried by the mounting brackets 136 and mounts the elevating lever 126 at one end. As heretofore described the connecting rod 138 is keyed or otherwise secured to the elevating lever for conjoint movement. The remaining elevating lever 126 is mounted similarly by a connecting rod 140 which is journelled in a link block 142 carried by the top plate above the weldment 34*a*.**

A pair of rods 130, 132 are connected beween the other arm 131 of the respective forward and rearward elevating levers 126. As will be discussed below, an input to the connecting rod 138 will cause each elevating lever through the rods 130, 132 and connecting rod 128, to translate pivotally through an equal displacement with the result that the carriage of the transporter apparatus will move upwardly or downwardly through a linear displacement commensuarate with the angular displacement.

The rods 130, 132, as the rods 122, are adjustable in length for purposes of initial orientation of structure.

Figure 3:
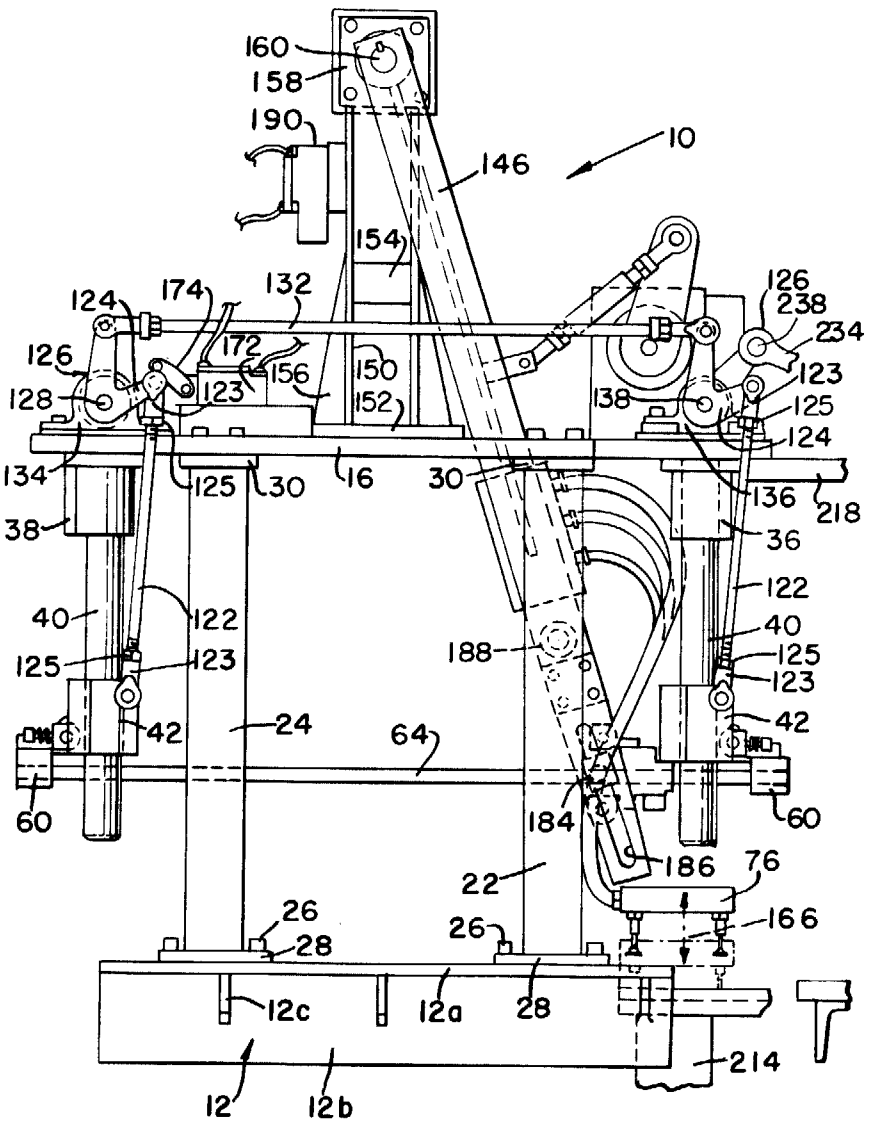
Figure 4:
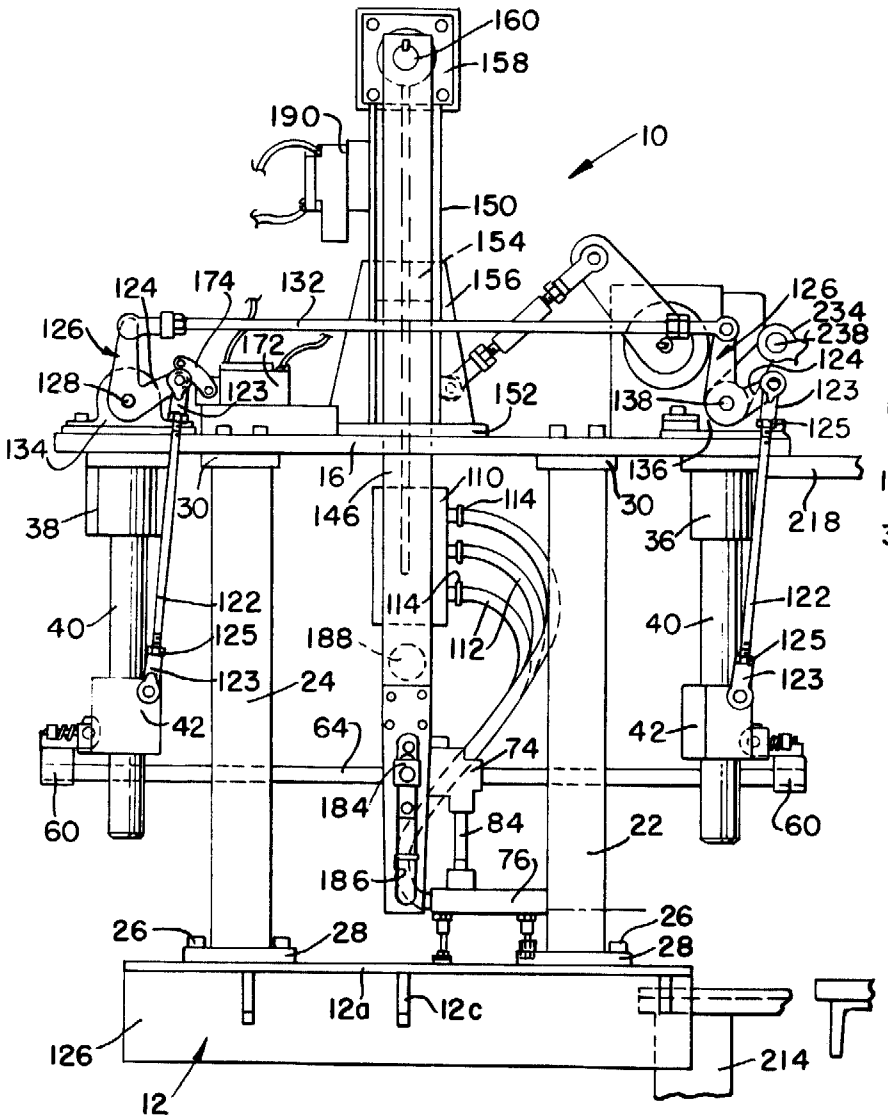

Movement of the transfer devices along the respective transfer rods 64 of the carriage of the transporter apparatus and the structure for imparting such moement now will be discussed. For this purpose, the transporter apparatus includes a pair of transfer arms 144, 146 which are mounted for pivotal movement between the position of FIG. 2 and the position of FIG. 4 representing the positions of the transfer arms when the blister members 46 are deposited in the several support openings 66 of the second conveyor 68 and when the blister membes are "gripped" at the pick-up zone, respectively. FIG. 3 illustrates an intermediate position of the transfer arms.

A pair of pivot brackets 148, 150 are mounted on pedestals 152 and extend upwardly from the top plate 16. Each bracket is formed generally by an elongated C-shaped channel having a horizontal rib 154 spaced from the pedestal 152 and a pair of vertical ribs 156 extending upwardly from the pedestal for support of the side walls. a plate 158 is carried at the end of each pivot bracket. A pivot shaft 160 is received through a bore in the web portion of each pivotal bracket as well as each plate secured across the walls. A journal 162 is supported by each plate for pivotal movement of a pair of transfer arms 144, 146 carried by a collar portion 164 on a pivot shaft 160. The transfer arms are keyed or otherwise secured to the pivot shaft for movement as imparted by the mechanical drive means, to be discussed.

A control (not shown) for the transporter apparatus 10 is activated thereby to initiate the operation now to be described. To this end, referring to FIG. 4, the carriage of the transporter apparatus is moved vertically downward in the direction of arrow 166 to locate the several pick-up heads 76 in the dotted line position for purposes of engaging an individual one of several blister means 46 at the pick-up zone. As indicated, this movement is controlled by the pivot movement of the elevating levers 126. In this connection, a lever including a collar 168 and an arm 170 (see FIG. 8) is mounted on the connecting rod 138 and keyed or otherwise connected to the connecting rod for conjoint movement. The lever is controlled in pivotal movement thereby to rotate connecting rod 138 through a predetermined rotational angle. Rotation of the connecting rod 138 is followed by pivotal movement of each elevating lever, as described, and by which movement is translated by rods 122 to vertical movement of the carriage of the transfer apparatus, also as described. Rotation of the connecting rod 138 in one direction will result in vertical downward movement and in the other direction in vertical upward movement of the carriage of the transporter apparatus. As illustrated, a clockwise pivot of elevating levers results in movement in the direction of arrow 166.

A switch 172 is mounted on the top plate 16 within the region of one of the elevating levers. The switch includes a switch arm 174 which cooperates with one arm of the elevating lever. The switch arm may be biased toward the arm of the elevating lever to signal the control (not shown) that the carriage of the transporter apparatus has passed a lower limit position during movement to the raised position. This signal is required to initiate operation of the drive to the transfer device for movement of the transfer blocks 76 from the position of FIG. 4 to the position of FIG. 2.

Figure 6:
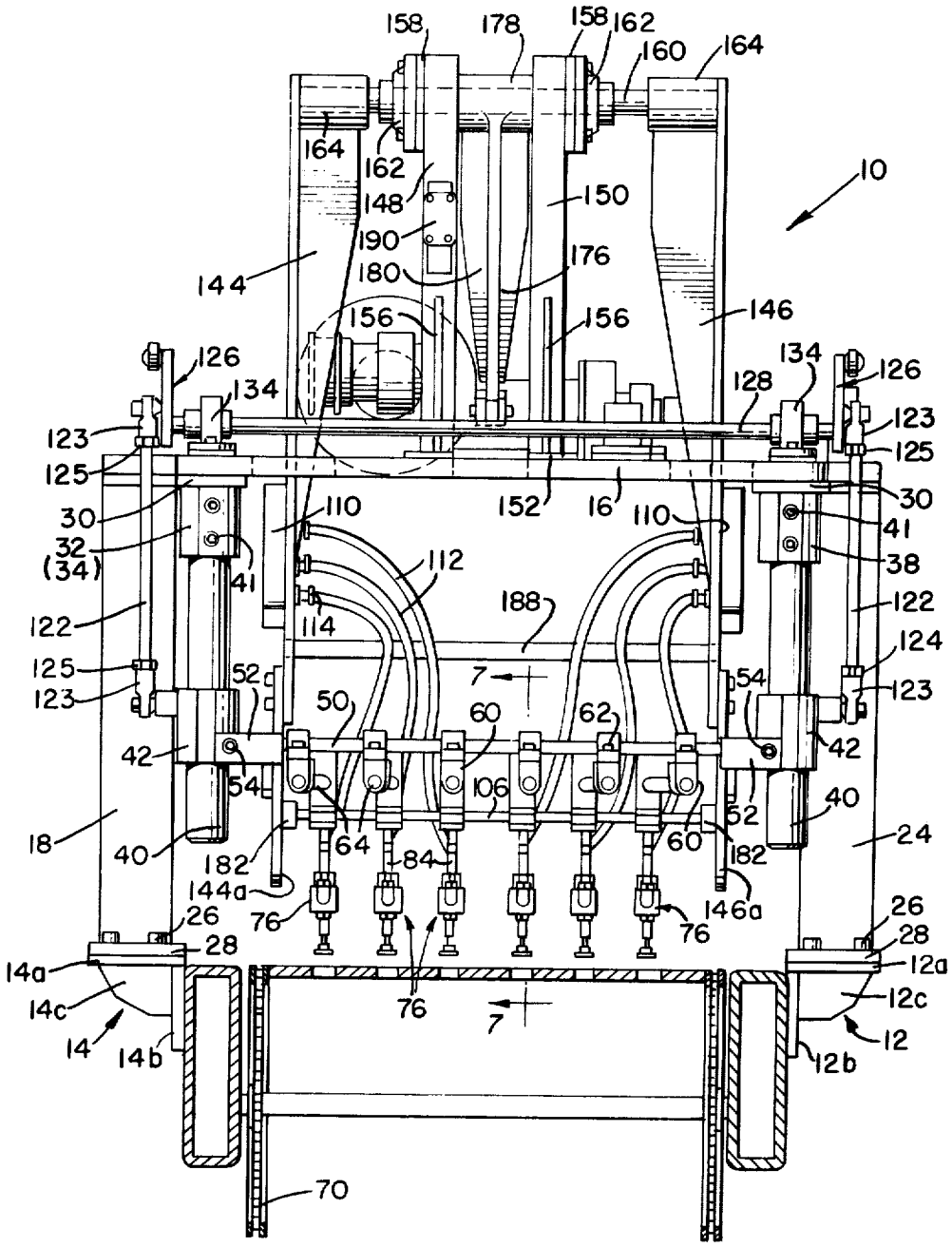
FIG. 6 is a view in front elevation of the transporter apparatus.

Referring to FIG. 6, a main transfer lever 176 including a collar 178 and an arm 180 is controlled in pivotal movement by structure to be described. The main transfer lever is received on the pivot shaft 160 between the pivot brackets 148, 150 and extends toward the top plat 16 for connection with the mechanical drive means. The main transfer lever is keyed or otherwise secured to the pivot shaft so that movement imparted to the arm 180 is translated to pivotal movement of the transfer arms 144, 146. The arm 180 of the main transfer lever is of extended length. To accommodate its movement as well as movement of the transfer arms 144, 146 the top plate 16 is suitably formed to provide generally rectangular openings therethrough (see FIG. 8).

When the carriage of the transporter apparatus moves upwardly a sufficient distance from the pick-up zone, the switch 172 will be actuated. The switch will be activated when the carriage of the transporter apparatus is at a height so that all obstacles to movement of the transfer devices in the forward direction are cleared.

The transfer arms 144, 146 carry extensions **144*a*, 146*a* which extend to a point below the transfer rods 64. The extensions may be secured to the transfer arms in any convenient manner. The transfer arms operate to move the transfer devices from the pick-up zone along the transfer rods 64 to the second conveyor. To this end, the transfer arms are connected to the transfer blocks by structure now to be described thereby to cause the transfer block to slide along the respective transfer rods 64** substantially from one end to the other.

Each of the transfer block rods 104, 106 extend between the transfer arms and mount a link 182 which is of an outline for connection with the transfer block rods at their ends. A set screw having an enlarged head 184 is received through each transfer arm and secured to the link. While the part are in close juxtaposition on opposite sides of the transfer arms there is freedom of movement of the head along a slot 186 formed in each extension **144*a*, 146*a*. A rod 188** may be secured between the transfer arms to maintain proper spacing.

Figure 2:
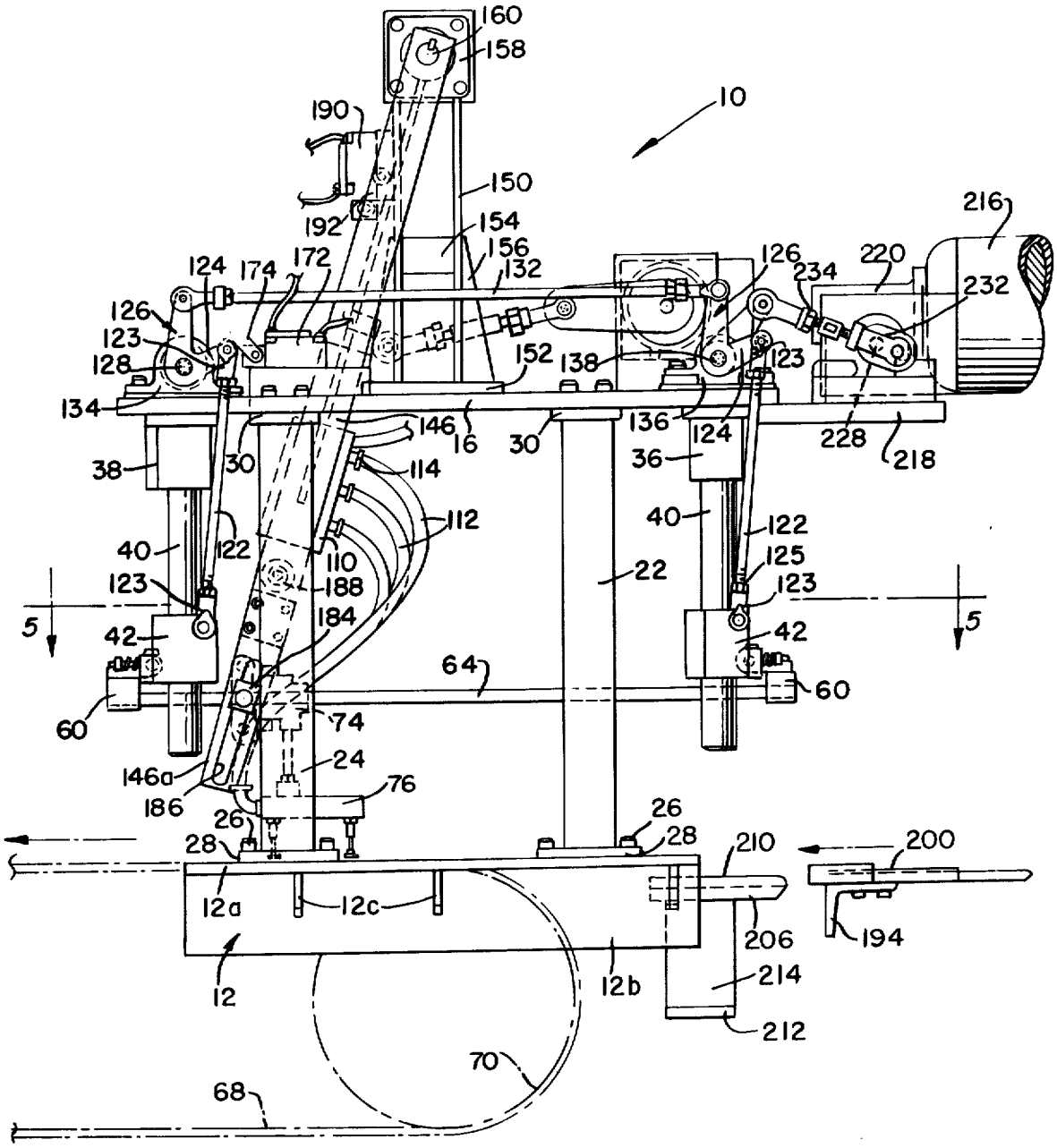
FIGS. 2–4 are views in side elevation of the transporter apparatus, the operative structure being illustrated in representative positions at and between the positions of pick-up and discharge of blister members.

Movement of the transfer arms between the position of FIGS. 2 and 4 is controlled. And movement of the transfer arms to the limit position of FIG. 4 controls, by a limit switch, such as switch 190, movement of the carriage to the lower limit position. The switch is supported by pivot bracket 148 and includes a switch arm 192 mounted to extnd into the path of movement of the main transfer lever 176. Particularly, the switch arm 192 may be biased into contact with a rib **176*a* formed on the lever for strengthening purposes. In this manner, when the main transfer lever and consequently the transfer arms have moved through a predetermined angle of rotation, switch 190 will be actuated to command the carriage to descend. The main transfer lever 176 then awaits a control to commence movement in the other direction. If the transfer arms are in the FIG. 2 position, movement in the other direction will commence upon signal to the control tat the carriage of the transporter apparatus in ascent has passed the lower limit position for actuation of switch 172**.

Referring again to FIG. 6, the manifolds 110 heretofore referred to for supplying pressure to the pick-up heads 76 are carried by the transfer arms 144, 146 in the region above the spacer rod 188. The manifolds are connected by means (not shown) to a suitable pressure source.

Turning briefly to FIGS. 2 and 5, the first conveyor connecting with the blister member former members (not shown) includes at its end near the pick-up zone a guide base 194 and a locater, both of which may be supported by structure (not shown) on the frame structure. A pluraity of blister member guide elements 196 generally in the shape of elongated parallelepipedonal members are provided to support the blister member in movmement toward the pick-up zone. The guide elements are spaced apart and support the flange of the blister member around the opening to the pocket on its top surface **196*a* so that the pocket extends into a channel therebetween. The guide elements are mounted to the guide base 194 by a convenient means received through the slots 198 (only one is shown). As may be appreciated the guide base will accommodate further guide elements if additional transfer devices are to be incorporated in the carriage of the transporter apparatus. A cover 200 is carried by a hinge 202 supported by the guide base in disposition over the guide elements. The cover rests on a cover stop 204 carried on the other side of the guide base 194 thereby to maintain a space between the cover and the top surface 196*a***.

An indexing or other movement (by structure not shown) causes the blister members to move along the guide elements 196 to a blister member guide 206. The blisther member guide is in the form of a plate includng a plurality of channels 208 and ribs 210 spaced to receive the pocket of the blister members and support the peripheral flanges of the blister member, respectively.

A pedestal 212 and a pair of side plates 214 support the blister member guide which defines the pick-up zone. Suitable means (not shown) support the pedestal on the frame structure. While the blister members traverse an open space between the separate guides to the pick-up zone, the cover 200 prevents the forward ends of the blister members from inclining downwardly. And any movement of the blister members in the lateral direction is compensated for by enlarging the entrances to the separate channels 208. The inclined walls of the ribs 210 will act to straighten the blister member for movement into the channels 208, all of which are in axial alignment.

The mechanical drive means for movement both of the carriage of the transporter apparatus and the transfer devices now will be described. In the preferred embodiment, the drive is an electro-mechanical drive having a motor 216 constituting the prime mover (see FIG. 8) supported by the mounting plate 218 which, in turn, is supported by the top plate 16. The motor may be of any continuously driving type. A speed reducer 220 providing of suitable gear reduction is connected to the output shaft of the motor in any conventional manner. The motor in the preferred embodiment is rated at 1725 rpm and the speed reducer provides a 20:1 gear reduction. The speed reducer has two outputs; one output of which is utilized for purposes of imparting movement to the transfer arms 144, 146 and the other output of which is utilized for purposes of imparting movement to the carriage of the transporter apparatus by way of the elevating levers 126 and associated structure.

The latter output provides an input to a rotation control 222 through a clutch coupling 224. The rotation control provides an incremental rotational output in response to a constant input from the speed reducer. Particularly, the rotation control provides a uni-directional rotational output to a shaft 228 through approximately one-half turn upon energization of a solenoid 226. The solenoid may be energized by the control (not shown) and the rotational output imparts somewhat to the carriage of the transporter apparatus, as will be discussed.

The rotation control may be a unit sold by Warner Electric Brake & Company, PSI Division, Pitman, New Jersey. This unit is described in Bulletin A-16, dated September, 1970, the specifics of which are incorporated herein by reference.

The shaft 228 is supported by a mounting bracket 230 received on the top plate 16 and includes a journal for rotational support of the shaft 228. A crank arm 232 is keyed to the end of the shaft.

A connecting rod 234 is mounted by a pivot pin 236 to the crank arm 232 and by a pivot pin 238 to the arm of lever 170 so that rotation of shaft 228 through a rotational angle of approximately 180° is translated to pivotal movement of the lever 170 in one direction while rotation of the shaft 228 through the next 180°, constituting one complete revolution, is translated to pivotal movement of the lever 170 in the opposite direction.

The other output of the speed reducer 220 provides a drive to one of a pair of timing pulleys 240, 242 supporting a timing pulley belt 244. A shaft 246, likewise supported by a mounting bracket 248 carried by the top plate 16, provides an input to a rotation control unit 250 of the type heretofore described. The rotation control unit likewise is controlled by a solenoid 252 and provides an incremental uni-directional drive of shaft 246 and throw arm 254.

The solenoid 252 may be energized by actuation of switch 172 whih signals that the carriage of the transporter apparatus has moved beyond the lower limit. Each actuation of the solenoid 252 will drive the throw arm 254 as has been discussed in connection with crank arm 232. A connecting member 256 is connected at its ends to the throw arm 254 and the main transfer arm 176 by means of pivot pins 258, 260. A pluraity of openings in the top plate 16 including the openings 262, 264 and 266 accommodate movement of the transfer arms 144, 146 and the main transfer arm 176.

Briefly, the overall operation is as follows: blister members are conveyed to the pick-up zone by structure as generally illustrted in FIGS. 2 and 5 at which they are "gripped"for transport to the conveyor 68. The carriage of the transporter apparatus is imparted movement to the lower limit position by the action of elevating levers 126 which in unison pivot clockeise (FIG. 2). This action commences at a preset time and movement is controlled by energization of the solenoid 226 which activates the clutch coupling 224 of rotation control 224. The one-half turn of shaft 228 prior to disengagement of the clutch opening, through crank arm 232, connecting rod 234, lever 170 and connecting rod 138, produces the described pivotal movement of the elevating levers 126. After a dwell period the solenoid 226 again activates the clutch coupling 224 and before disengagement the shaft 228 will turn through the remaining portion a full turn. The time period during which each one-half turn takes place and the rotational speed of the shaft will be substantially similar. Thus, the movement of the carriage of the transporter apparatus from the raised to the lower and from the lower to the raised limit positions will be substantially uniform in speed and carried out over substantially the same time interval.

While there is a continuous output from the speed reducer 220 there is no movement of the elevating levers except as controlled by solenoid 226.

As the carriage of the transporter apparatus moves from the lower limit position under control of the elevating levers 126, switch 172 will be actuated through switch arm 174. Switch 172 controls the operation of solenoid 252 thereby in somewhat similar manner to drive the transfer arms 144, 146 from the position of FIG.2 to the position of FIG. 4. Activation of switch 172 has no effect on the movement of the carriage of the transporter apparatus which continues ascent to the raised limit position, at which position it will remain until commanded to undergo the same sequence of movement. A command signal is derived through actuation of switch 190 by movement of the main transfer arm 176.

As has been described, movement of the transfer arms 144, 146 under control of the main transfer arm 176 is imparted through the other output of speed reducer 220 through the pulley arrangement and shaft 246, driven in a manner as shaft 228. Thus, as shaft 246 and throw arm 254, connected to the main transfer arm 176 by connecting member 256, rotates through each one-half revolution of its uni-directional drive the main transfer arm 176 is caused to pivot between the positions heretofore set out. Movement of the main transfer arm 176 is followed by movement of the transfer arms 144, 146 through pivot shaft 160. The angle of pivotal movement is controlled by the length of stroke connecting member 256.

Movement of the transfer arms 144, 146 is translated to movement of the transfer devices along transfer rods 64. As described in connection with FIG. 1, the movements of the transfer devices and the carriage of the transporter apparatus which supports the transfer devices are carried out individually and simultaneously in transporting the blister members from the pick-up zone to the second conveyor and in the return of the structure prior to a subsequent transporting operation.

Having described the invention with particular reference to the preferred form thereof, it will be obvious to those skilled in the art to which the invention pertains after understanding the invention, that various changes and modifications may be made therein without departing from the spirit and scope of the invention as defined by the claims appended hereto.

Having described the invention, what is claimed is:

1. A transporter apparatus for transporting a plurality of articles picked-up at a first location to a second location removed therefrom and at which the articles are deposited at different spacing comprising in combinations, frame means, carriage means, first means supporting said carriage means on said frame means for movement of said carriage means limited to movement in mutually opposite directions between a pair of spaced limit positions, transfer means at least equal in number to the number of articles transported movable between said locations, the movement of said transfer means between said locations including movement in a direction substantially perpendicular to the direction of movement of said carriage means, second means supporting each said transfer means on said carriage means, prime mover means having an output, first movement producing means connecting said output to said carriage means for moving said carriage means between said pair of spaced limit positions, second movement producing means connecting said output to said second supporting means for moving each said transfer means between said locations, and each of said first and second movement producing means including an intermittently engageable uni-directional drive coupling whereby said carriage means and each said transfer means undergo movement both concurrently and individually.

2. The transporter apparatus of claim 1 wherein said first movement producing means includes at least one lever, means mounting each said lever on said frame means for movement about a pivot axis, and an element connecting each said lever and said carriage means whereby upon movement of each said lever in one direction said carriage means moves from one limit to a second limit of said pair of limit positions and upon movement of each lever in the other direction said carriage means returns to said one limit.

3. The transporter apparatus of claim 2 wherein said lever mounting means comprises a rotatable member, a lever arm carried by said rotatable member, and wherein said first movement producing means includes a first driven shaft, a first crank arm, said crank arm being carried by said first driven shaft, and a first connecting member mounted between said first crank arm and said lever arm.

4. The transporter apparatus of claim 3 including a plurality of levers, and means for ganging together said levers for conjoint movement.

5. The transporter apparatus of claim 1 including a source of negative pressure, conduit means for coupling said pressure source to each said transfer means, and each said transfer means including a bore, at least one probe having a tip adapted to engage with said blister member, and each said probe in fluid connection with said bore whereby said blister member may be "gripped" by said tip for movement from said first to said second location.

6. The transporter apparatus of claim 1 wherein said plurality of articles picked up at said first location are moved to said second location along a path constituting the resultant of vectors in the vertical, horizontal and lateral directions and wherein said first and second movement producing means may move said transfer means towards said second location in a direction including at least two of said vectors.

7. A transporter apparatus for transporting a plurality of articles picked-up at a first location to a second location removed therefrom and at which the articles are deposited at different spacing comprising, in combination:

a. frame means,
b. carriage means, said carriage means including
   1. a plurality of housings comprising a first and second air of housings, one of said pairs of housings being disposed substantially within the region of said first location and the other of said pairs of said housings being disposed substantially within the region of said second location,
   2. a pair of cross bars,
   3. means for mounting each said cross bar to respective pairs of housings,
   4. a plurality of transfer rods, and
   5. means mounting each said transfer rod between said cross bars;
c. first means supporting said carriage means on said frame means for movement in mutually opposite directions between a pair limit positions;
d. transfer means equal in number to the number of articles transported movable between said locations, each said transfer means mounted on a respective transfer rod for sliding movement between said locations, the resultant of which is substantially perpendicular to the movement of said carriage means;
e. second means supporting each said transfer means on said carriage means;
f. prime mover means having an output;
g. first movement producing means connecting said output to said carriage means for moving said carriage means between said pair of limit positions; and,
h. second movement producing means connecting said output to said second supporting means for moving each said transfer means between said locations, each of said first and second movement producing means including an intermittently engageable uni-directional drive coupling whereby said carriage means and each said transfer means may be moved both concurrently and individually.

8. The transporter apparatus of claim 7 wherein said first supporting means includes a plurality of guide posts, and means mounting said guide posts on said frame means whereby said guide posts are substantially coextensive and disposed in a parallel family, each said housing being supported by and slidable along a respective guide post during movement of said carriage means.

9. The transporter apparatus of claim 7 wherein substantially all of said transfer rods are divergent from said first location toward said second location.

10. The transporter apparatus of claim 7 wherein said second supporting means comprises a body member for each said transfer means, each said body member mounted for generally axial sliding movement along said transfer rod.

11. The transporter apparatus of claim 10 wherein said second movement producing means includes transfer arm means, means mounting said transfer arm means on said frame means for pivotal movement, and means connecting said transfer arm means and said body member whereby upon movement of said transfer arm means in one direction said transfer means moves from one limit to a second limit of said second pair of limit positions and upon movement of said transfer arm means in the other direction said transfer means returns to said one limit.

12. The transporter apparatus claim 11 wherein said second movement producing means further includes a second driven shaft, a second crank arm, said second crank arm being carried by said second driven shaft, and a second connecting member mounted between said second crank arm and said transfer arm means.

13. The transporter apparatus of claim 11 including body member rod means, each said body member additionally mounted on said body member rod means for lateral sliding movement, and wherein said transfer arm means includes a pair of transfer arms, said body member rod means being mounted to said transfer arms at opposite ends.

* * * * *